United States Patent [19]

Kameyama

[11] Patent Number: 5,024,190

[45] Date of Patent: Jun. 18, 1991

[54] OIL SUPPLY DEVICE FOR TWO CYCLE ENGINE

[75] Inventor: Takuma Kameyama, Hamamatsu, Japan

[73] Assignee: Sanshin Kogyo Kabushiki Kaisha, Hamamatsu, Japan

[21] Appl. No.: 448,704

[22] Filed: Dec. 11, 1989

[30] Foreign Application Priority Data

Dec. 12, 1988 [JP] Japan ..... 63-311865

[51] Int. Cl.[5] ..... F01M 1/00

[52] U.S. Cl. ..... 123/196 R; 123/73 AD; 417/250; 184/6.5

[58] Field of Search ..... 123/196 R, 196 CP, 73 AD; 417/250, 395; 184/6.5, 6.23

[56] References Cited

U.S. PATENT DOCUMENTS

| | | | |
|---|---|---|---|
| 4,475,488 | 10/1984 | Odashima | 123/196 CP |
| 4,480,602 | 11/1984 | Kobayashi et al. | 123/196 R |
| 4,583,500 | 4/1986 | Hundertmark | 123/196 R |
| 4,594,970 | 6/1986 | Baars et al. | 123/196 R |
| 4,846,307 | 7/1989 | Kinouchi et al. | 184/6.5 |
| 4,846,308 | 7/1989 | Sui | 184/6.23 |

FOREIGN PATENT DOCUMENTS

| | | | |
|---|---|---|---|
| 2822209 | 11/1979 | Fed. Rep. of Germany | 123/196 CP |
| 3621720 | 1/1987 | Fed. Rep. of Germany | 123/196 R |
| 0044410 | 4/1981 | Japan | 123/196 AB |
| 0277812 | 12/1986 | Japan | 123/196 R |
| 0041619 | 2/1989 | Japan | 123/196 R |

*Primary Examiner*—David A. Okonsky
*Attorney, Agent, or Firm*—Ernest A. Beutler

[57] ABSTRACT

A lubricating system for a two cycle internal combustion engine as applied to an outboard motor wherein small amounts of lubricant can be pumped by a diaphragm type pump through the use of an air bleed that mixes air with the lubricant being pumped. Pulsation variations are minimized by supplying the pump with lubricant with a constant volume delivery chamber.

13 Claims, 4 Drawing Sheets

OIL SUPPLY DEVICE FOR TWO CYCLE ENGINE

BACKGROUND OF THE INVENTION

This invention relates to an oil supplying device for a two cycle engine and more particularly to an improved pumping arrangement for delivering lubricant to an engine.

It is well known that internal combustion engines require lubricating systems and four cycle engines normally employ a crankcase and lubricating system wherein the oil is pumped to the engine for lubrication and return to the crankcase. With a two cycle engine, on the other hand, the lubricant is normally supplied with the intake charge and frequently is mixed with the fuel so that it will be in contact with the parts of the engine to be lubricated and then is discharged through the exhaust of the engine. Recently it has been proposed to provide a separate lubricating system for engines wherein the lubricant is not mixed with the fuel but rather is delivered to the engine by some form of pump. However, since the lubricant is discharged to the atmosphere it is extremely important to insure that the amount of lubricant supplied under some running conditions is quite small. Conventional pumps cannot handle accurately such small amounts of lubricant flow.

It is, therefore, a principal object of this invention to provide an improved lubricant supply system for an internal combustion engine.

It is a further object of this invention to provide a lubricant supply system for an internal combustion engine in which very small amounts of lubricant can be delivered.

It is a further object of this invention to provide an improved lubricating system for a two cycle internal combustion engine.

In connection with the lubrication systems for two cycle engines, it is possible to drive the lubricant pump in a number of manners. Pumps that are driven mechanically from the engine output shaft or some other rotating component of the engine obviously complicate the engine construction. It is also possible to use an electrically driven pump for his purpose but such pumps require obviously a battery or power source. Thus, this also complicates the engine. Therefore, it has been the practice to employ a pulsating type pump that is of the diaphragm or piston type and which is operated by the crankcase pressure variations that exist with such engines. Such devices have the advantage of being quite simple and can be located in any of the a wide variety of locations relative to the engine. However, this type of pumping device has several disadvantages.

In the first instance, it is quite difficult to have this type of pump, which is generally a positive displacement pump, pump the small amounts of lubricant as aforenoted. Furthermore, the amount of lubricant pumped by this type of pump can vary with the level of the lubricant in the supply tank that feeds the pump and also with changes in viscosity as occur due to temperature variations. In addition, by its very nature and cyclic operation the quantity of lubricant pumped by the pump will fluctuate.

It is, therefore, a still further object of this invention to provide an improved and simplified positive displacement pump for delivering lubricant to an engine.

It is a still further object of this invention to provide an improved, simplified lubricant pump that will pump small quantities of lubricant and without having significant cyclic variations.

SUMMARY OF THE INVENTION

A first feature of this invention is adapted to be embodied in a lubricating system for an internal combustion engine that includes a lubricant pump and conduit means for conveying lubricant from the pump to the engine. In accordance with this feature of the invention, means are provided for mixing another fluid with the lubricant upon delivery to the pump for pumping small amounts of lubricant.

Another feature of this invention is adapted to be embodied in a lubricant pump having a displacement member that is reciprocated in response to crankcase pressure variations for pumping fluid. In accordance with this feature of the invention, fuel from a constant volume chamber is supplied to the pump for its pumping operation.

Yet another feature of this invention is adapted to be embodied in an improved compound pressure operated pump having a pump housing in which two pumping diaphragms are provided each of which is adapted to pump fluid. In accordance with this feature of the invention, both pumping diaphragms are operated from a common source of pulsating pressure.

DETAILED DESCRIPTION OF THE PREFERRED EMBODIMENTS OF THE INVENTION

Figure 1:
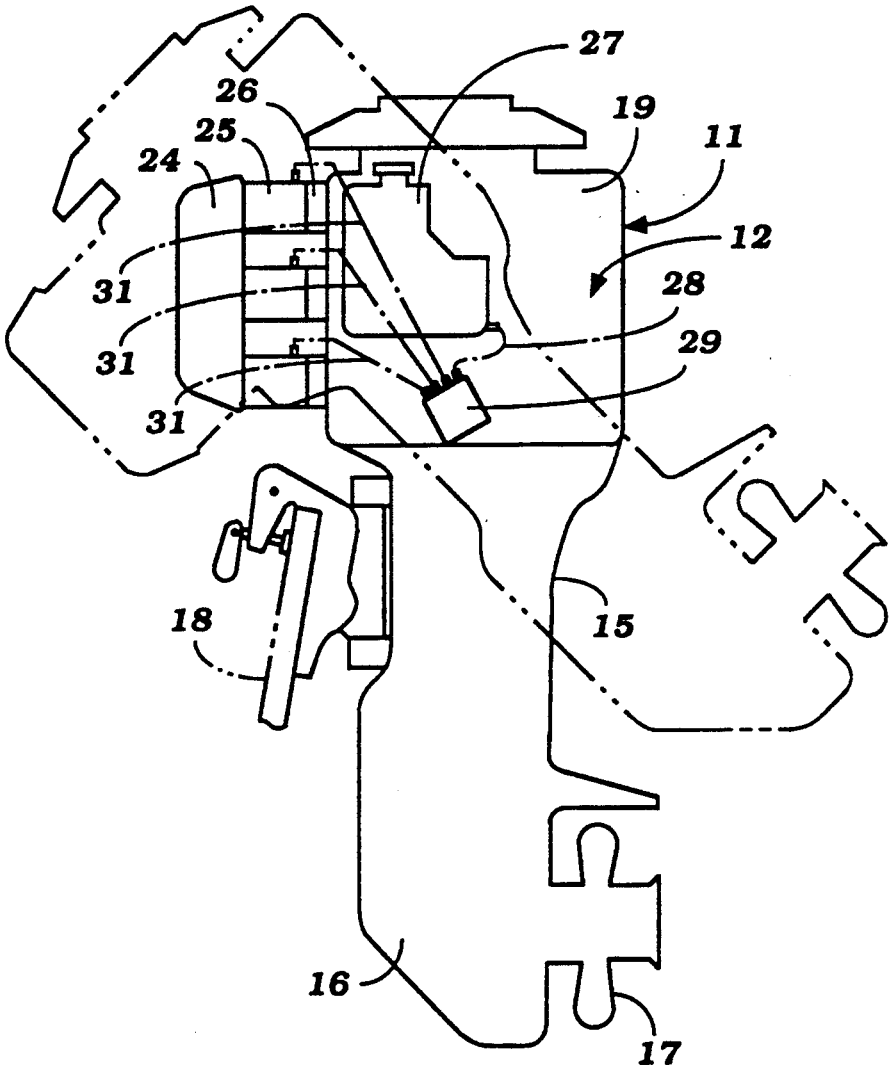
FIG. 1 is a side elevational view of an outboard motor constructed in accordance with an embodiment of the invention showing the engine in its normal running condition and in a tilted up condition in phantom.

Referring first in detail to FIG. 1, an outboard motor constructed in accordance with an embodiment of the invention is identified generally by the reference numeral 11. It is to be understood that the invention is described in conjunction with an outboard motor because outboard motors normally employ engines having lubricating systems of the type with which this invention finds utility. It is to be understood, however, that the invention may be employed in other engine applications and with other types of engines than those which will be described hereinafter.

The outboard motor 1; includes a powerhead that is comprised of an internal combustion engine 12 and a surrounding protective cowling, which is removed in the figures to more clearly show the invention. As may be seen in FIG. 2, the engine 12 in the illustrated embodiment is of the three cylinder in line type and operates on the two stroke crankcase compression principle. As is typical with outboard motor practice, the crankshaft 13 of the engine rotates about a vertically extending- axis and drives a driveshaft 14 which also rotates about a vertically extending axis.

The driveshaft is journalled within a driveshaft housing 15 that depends from the powerhead of the engine and which contains a transmission (not shown) for driving a propulsion device such as a propeller 17.

The outboard motor 11 is designed to be affixed to a transom 18 of a watercraft in a known manner.

Figure 2:
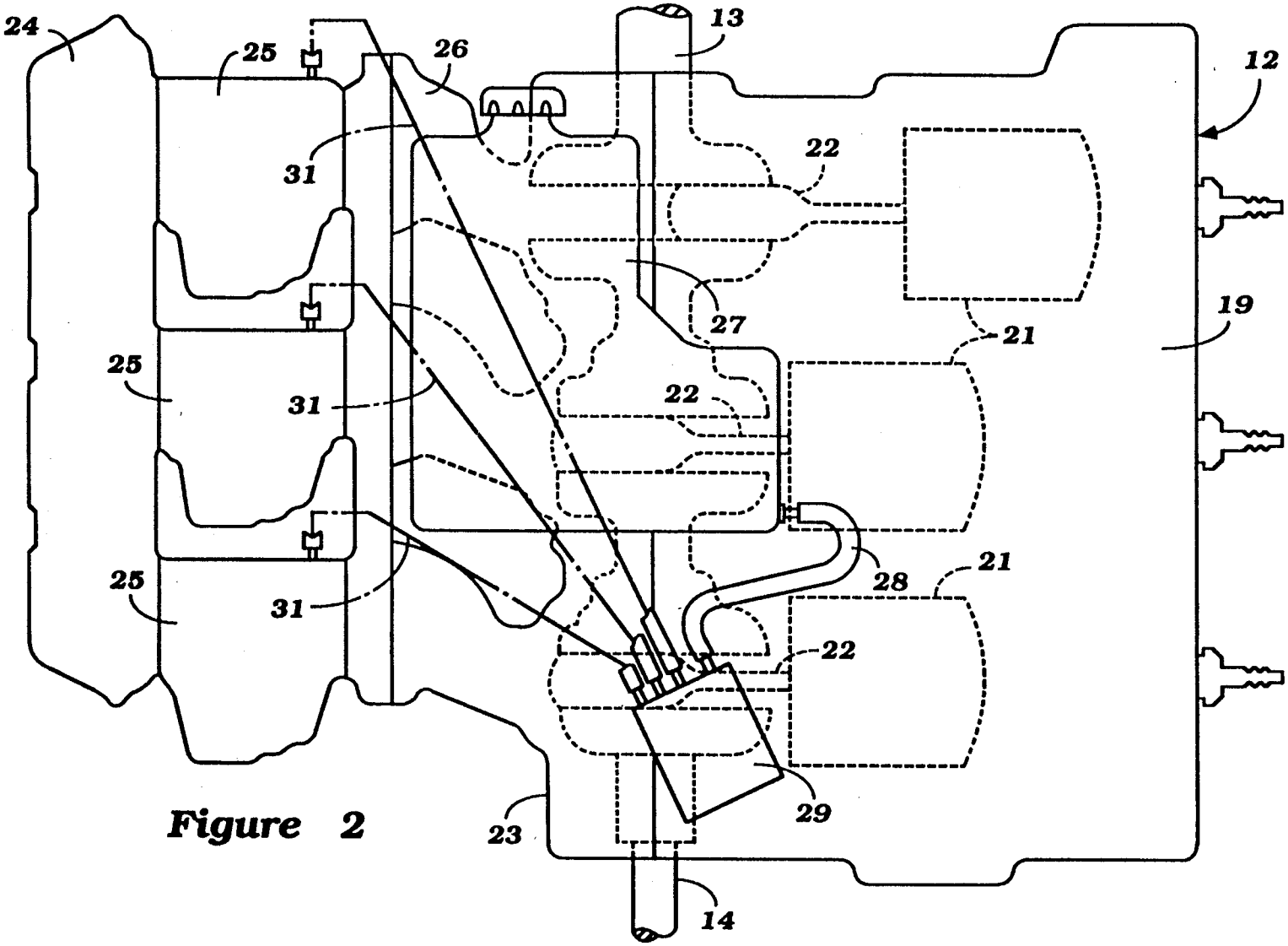
FIG. 2 is an enlarged side elevational view of the internal combustion engine of the outboard motor.

Referring now primarily to FIG. 2, the engine 12 is comprised of a cylinder block/cylinder head assembly 19 that has cylinder bores in which pistons 21 reciprocate. The pistons 21 are connected by means of connecting rods 22 to drive the crankshaft 13 in a known manner. The crankshaft 13 is journalled between the cylinder block/cylinder head assembly 19 and a crankcase casing 23. As is typical with two cycle engine practice, the individual crankcase chambers associated with the pistons 21 are isolated from each other by means of suitable seals.

A charge forming system is also provided for supplying a fuel air change to these crankcase chambers. This charge forming system includes an air inlet device 24 that draws an inlet air mixture and delivers it to individual carburetors 25 wherein the fuel air charge is formed. The carburetors 25 discharge this fuel air charge into an intake manifold 26 which, in turn, delivers the charge to the aforenoted crankcase chambers through reed type check valves (not shown).

Construction of the engine 13 as thus far described may be considered to be conventional and, as aforenoted, the particular type of engine described is just typical of the environment in which the invention may reside. However, the engine 12 is provided with a separate lubricating system, now to be described, that includes a pumping system constructed in accordance with a embodiment of the invention.

The lubricating system includes a lubricant storage tank 27 that is mounted within the powerhead of the engine and on a side of the cylinder block/cylinder head assembly 19 in a suitable manner. Lubricant is supplied from this tank 27 through a conduit 28 to a pumping and mixing mechanism, indicated generally by the reference number 29 and which will be described in more detail by reference to FIGS. 3 and 4. The lubricant pumped by the pumping device 29 is delivered to the induction passages of the carburetors 25 downstream of their throttle valves and to any desired components of the engine by means of delivery conduits 31.

Figure 3:
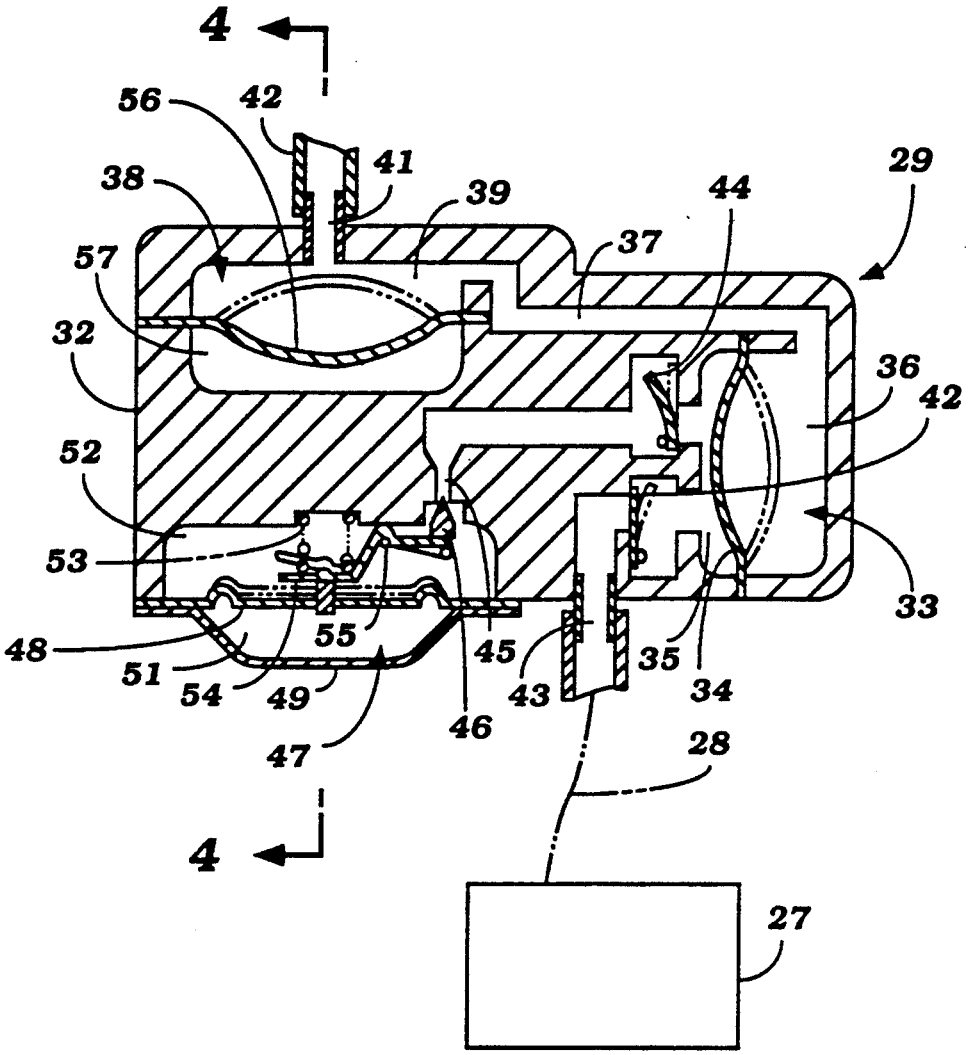
FIG. 3 is a further enlarged cross sectional view showing the lubricant pump system for the engine.
Figure 4:
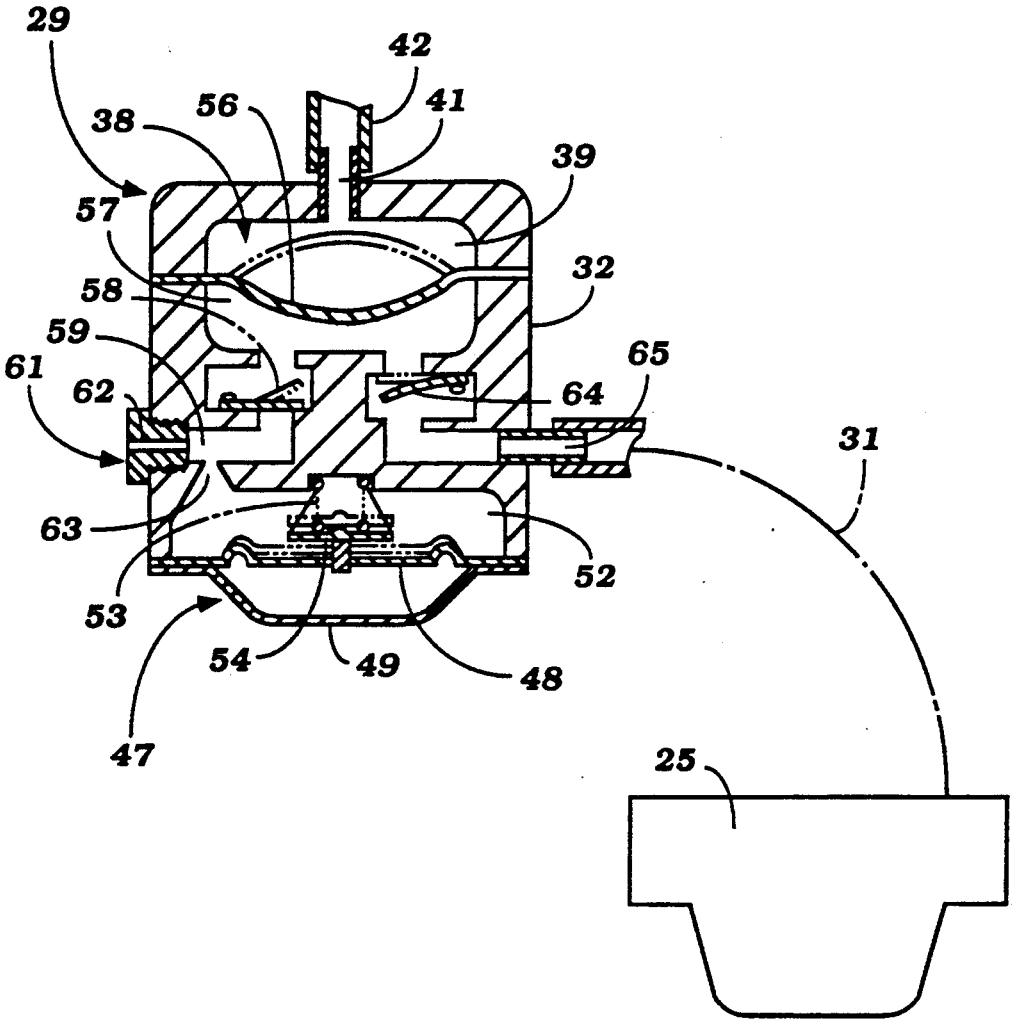
FIG. 4 is a cross sectional view taken along the line 4—4 of the FIG. 3.

Referring now in detail to FIGS. 3 and 4, the pumping device 29 is comprised of a main housing assembly, indicated generally by the reference numeral 32 in which a supply-pump assembly, indicated generally by the reference numeral 33 is positioned. The supply pump 33 is of the diaphragm type and is actuated by fluctuations in the pressure in one of the crankcase chambers of the engine. The pump 33 is comprised of a diaphragm 34 that defines a pumping chamber 35 and a pressure sensing chamber 36. The pressure sensing chamber 36 receives crankcase pressure variations through a conduit 37 which, in turn, communicates with a corresponding chamber of a delivery pump, indicated generally by the reference numeral 38. The delivery pump 38 has a pressure chamber 39 and the chambers 39 and 36 communicate with the crankcase chamber through a fitting 41 and conduit 42.

Lubricant is drawn into the pumping chamber 35 through a delivery check valve 42 when the diaphragm 34 is moving to the distended position shown in phantom in FIG. 3. The lubricant conduit 28 communicates with an inlet fitting 43 upstream of the delivery valve 42. When the diaphragm 34 moves back to the solid line position shown in FIG. 3, the lubricant is delivered through a delivery check valve 44 to a conduit 45 in which a needle valve 46 is positioned. The needle valve 46 is operated by a constant volume mechanism, indicated generally by the reference numeral 47 which functions so as to provide a constant supply of lubricant to the delivery pump 38. This constant volume mechanism includes a diaphragm 48 that is held to the main housing 32 by means of a cover plate 49 and which defines an atmospheric pressure chamber 51. A fluid holding chamber 52 is formed on the other side of the diaphragm 48 and a coil compression spring 53 acts against the diaphragm and a connecting arm 54 associated with the diaphragm so as to cause the diaphragm to move in a downward direction. When there is sufficient lubricant in the chamber 52, the diaphragm 48 will be in the solid line position shown in FIG. 3 and the needle valve 46 will be held closed. However, when the lubricant depletes and the diaphragm 48 moves upwardly, the connecting lever 54 will pivot about its fulcrum 55 and open the needle valve 46 to permit additional lubricant to be delivered in the chamber 52.

The device 47, therefore, maintains a uniform supply of lubricant for the delivery pump 38 and hence variations in crankcase pressure or head of lubricant in the supply tank will not effect the amount of lubricant that is pumped by the delivery pump 38. Rather than using the diaphragm type of device described, it would also be possible to employ a float operated arrangement for maintaining a uniform supply of fuel for the delivery pump 38. Also, if the lubricant tank 27 is positioned vertically above the pumping assembly, the supply pump 33 may be deleted if gravity flow is sufficient. In this event, the conduit 45 would be connected directly to the supply line 28.

Referring now to FIG. 4, the delivery pump 38 includes a diaphragm 56 which defines the aforenoted pressure chamber 33 and a pumping chamber 57. The pumping chamber 57 communicates with the chamber 52 of the constant volume device 47 through a delivery check valve 58 and conduit 59. In accordance with a feature of the invention, an air metering jet 61 having a air flow metering opening 62 communicates the conduit 59 with the atmosphere between the check valve 58 and a supply port 63 through which the conduit 59 communicates with the chamber 52. As a result, the lubricant pumped by the delivery pump 38 will be mixed with air. Thus, the amount of lubricant pumped during each cycle of operation of the diaphragm 56 will be less than the total displacement since the lubricant is mixed with this atmospheric air. As a result, it is possible to pump very small amounts of lubricant. Because of the viscosity of the lubricant being pumped, the air that is admitted will form a heavy emulsion which can be adequately handled by the system.

The air and lubricant pumped by the diaphragm 56 is discharged through a discharge check valve 64 to a plurality of discharge ports 65 each of which communicates with one of the aforenoted supply conduits 31.

It should be readily apparent from the construction described that a very compact pump assembly is provided which will also be capable of pumping extremely small amounts of lubricant and which will provide a constant lubricant supply without any significant pulsating action and which will be independent of variations in the amount of lubricant in the supply tank. Also, this permits the outboard motor to be operated and run in a tilted up condition as shown in phantom in FIG. 1 without any loss of lubrication for the engine. Although embodiments of the invention have been illustrated and described, various changes and modifications may be made without departing from the spirit and scope of the invention, as defined by the appended claims.

I claim:

1. A lubricating system for an internal combustion engine comprising a lubricant pump for pumping lubricant, conduit means for conveying lubricant to the engine from said lubricant pump, and means for mixing a controlled amount of another fluid with said lubricant prior to delivery to said pump for pumping small amounts of lubricant.

2. A lubricating system for an internal combustion engine as set forth in claim 1, wherein the other fluid is a nonhydrocarbon.

3. A lubricating system for an internal combustion engine as set forth in claim 1, wherein the other fluid comprises air.

4. A lubricating system for an internal combustion engine as set forth in claim 1, wherein the pump comprises a displacement type device.

5. A lubricating system for an internal combustion engine as set forth in claim 4, wherein the displacement volume of the pump per cycle is greater than the amount of lubricant pumped.

6. A lubricating system for an internal combustion engine as set forth in claim 5, wherein the pump is actuated by a pressure variation within the associated engine and wherein the engine is a two cycle crankcase compression engine.

7. A lubricating system for an internal combustion engine as set forth in claim 6, wherein the other fluid is a nonhydrocarbon.

8. A lubricating system for an internal combustion engine as set forth in claim 7, wherein the other fluid comprises air.

9. A lubricating system for an internal combustion engine as set forth in claim 4, further comprising a delivery chamber on the inlet side of said pump and maintained with a constant volume of lubricant for supply to said pump.

10. A lubricating system for an internal combustion engine as set forth in claim 9, further including a second pump for delivering lubricant to said delivery chamber.

11. A lubricating system for an inter combustion engine as set forth in claim 10, wherein the first and second pumps and delivery chamber are all formed within a common housing assembly and wherein both of said pumps are actuated by the same pressure signal from the engine.

12. A lubricating system for an internal combustion engine as set forth in claim 11, wherein the other fluid is a nonhydrocarbon.

13. A lubricating system for an internal combustion engine as set forth in claim 12, wherein the other fluid comprises air.

* * * * *